US010428611B2

(12) United States Patent
Michael et al.

(10) Patent No.: US 10,428,611 B2
(45) Date of Patent: Oct. 1, 2019

(54) APPARATUS AND METHOD FOR IN-SITU STABILIZATION OF UNCONSOLIDATED SEDIMENT IN CORE SAMPLES

(71) Applicant: Saudi Arabian Oil Company, Dhahran (SA)

(72) Inventors: Nikolaos A. Michael, Abqaiq (SA); Maher I. Marhoon, Dhahran (SA); Peng Lu, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/854,996

(22) Filed: Dec. 27, 2017

(65) Prior Publication Data

US 2019/0195037 A1 Jun. 27, 2019

(51) Int. Cl.
*E21B 25/08* (2006.01)

(52) U.S. Cl.
CPC ..... *E21B 25/08* (2013.01)

(58) Field of Classification Search
CPC ..... E21B 25/08
See application file for complete search history.

(56) References Cited

U.S. PATENT DOCUMENTS

| | | | |
|---|---|---|---|
| 1,373,492 | A | 4/1921 | Dodds |
| 1,784,886 | A | 12/1930 | Baker |
| 1,896,703 | A | 2/1933 | Dean |
| 1,987,853 | A | 1/1935 | Howard et al. |
| 2,141,261 | A | 12/1938 | Clark |
| 2,170,716 | A | 8/1939 | Higgins, Jr. |
| 2,221,392 | A | 11/1940 | Baker |
| 2,382,992 | A | 8/1945 | Harris |
| 2,532,716 | A | 12/1950 | Havlick |
| 2,698,737 | A | 1/1955 | Dean |
| 2,740,477 | A | 4/1956 | Monaghan |

(Continued)

FOREIGN PATENT DOCUMENTS

| | | | |
|---|---|---|---|
| EP | 0588664 | A2 | 3/1994 |
| FR | 2036451 | A5 | 12/1970 |
| KR | 20030077055 | A | 10/2003 |

OTHER PUBLICATIONS

Gardner, Kenneth L.; "Impregnation technique using colored epoxy to define porosity in petrographic thin sections" Can. J. Earth Sci. vol. 17 1980; pp. 1104-1108.

(Continued)

*Primary Examiner* — Giovanna C Wright
*Assistant Examiner* — Brandon M Duck
(74) *Attorney, Agent, or Firm* — Bracewell LLP; Constance G. Rhebergen; Vivek P. Shankam

(57) ABSTRACT

Apparatus and method for in-situ stabilization of unconsolidated sediment in core samples are disclosed. The core sampling apparatus includes a corer having an inner wall, an outer wall, and a plurality of impregnation tubes disposed between the inner and the outer wall, wherein the impregnation tubes are parallel to a central axis of the corer. The method for sampling a core includes extracting a core sample using a corer, and in-situ stabilizing unconsolidated sediment in the core sample within the corer by impregnating the core sample with a resin. The resin is supplied through a plurality of impregnation tubes disposed between the walls of the corer.

10 Claims, 7 Drawing Sheets

(56) References Cited

U.S. PATENT DOCUMENTS

| | | | |
|---|---|---|---|
| 3,064,742 | A | 11/1962 | Bridwell |
| 3,066,748 | A | 12/1962 | Doherty |
| 3,139,147 | A | 6/1964 | Hays et al. |
| 3,146,837 | A | 9/1964 | Bridwell |
| 3,163,241 | A | 12/1964 | Daigle et al. |
| 3,298,450 | A | 1/1967 | Sato |
| 3,372,760 | A | 3/1968 | Raymond et al. |
| 3,438,452 | A | 4/1969 | Bernard et al. |
| 3,497,018 | A | 2/1970 | Shultz et al. |
| 3,794,127 | A | 2/1974 | Davis |
| 3,807,234 | A | 4/1974 | Duperon |
| 3,833,075 | A | 9/1974 | Bachman et al. |
| 3,878,904 | A | 4/1975 | Dobson |
| 3,952,817 | A | 4/1976 | Anderson |
| 4,081,040 | A | 3/1978 | Henson |
| 4,234,046 | A | 11/1980 | Haynes |
| 4,310,057 | A | 1/1982 | Brame |
| 4,317,490 | A | 3/1982 | Milberger |
| 4,335,622 | A | 6/1982 | Bartz |
| 4,350,051 | A | 9/1982 | Thompson |
| 4,356,872 | A | 11/1982 | Hyland |
| 4,518,050 | A | 5/1985 | Sollie et al. |
| 4,552,229 | A | 11/1985 | Radford et al. |
| 4,605,075 | A | 8/1986 | Radford et al. |
| 4,606,416 | A | 8/1986 | Knighton et al. |
| 4,607,710 | A | 8/1986 | Radford |
| 4,669,554 | A | 6/1987 | Cordry |
| 4,671,367 | A * | 6/1987 | Brunsing ..... E02D 27/42 175/253 |
| 4,716,974 | A * | 1/1988 | Radford ..... E21B 25/08 175/59 |
| 4,804,050 | A | 2/1989 | Kerfoot |
| 4,807,707 | A | 2/1989 | Handley et al. |
| 4,930,587 | A | 6/1990 | Young et al. |
| 4,946,000 | A | 8/1990 | Gibson et al. |
| 5,101,917 | A | 4/1992 | Abdul et al. |
| 5,253,720 | A | 10/1993 | Radford et al. |
| 5,419,211 | A | 5/1995 | Rodel et al. |
| 5,771,985 | A | 6/1998 | Jaworski |
| 6,009,960 | A | 1/2000 | Leitko, Jr. et al. |
| 6,443,243 | B1 | 9/2002 | Griffin, Jr. |
| 6,659,204 | B2 | 12/2003 | Aumann et al. |
| 8,684,110 | B2 | 4/2014 | Reid, Jr. et al. |
| 9,051,800 | B2 | 6/2015 | Matthews et al. |
| 9,322,265 | B2 | 4/2016 | Kong |
| 9,506,307 | B2 | 11/2016 | Kinsella |
| 2003/0089526 | A1 | 5/2003 | Beeker |
| 2003/0205408 | A1 | 11/2003 | Lee et al. |
| 2008/0283298 | A1 | 11/2008 | Garcia et al. |

OTHER PUBLICATIONS

International Search Report and Written Opinion for International PCT application PCT/US2018/067485 (SA5795) report dated Apr. 2, 2019; pp. 1-11.

* cited by examiner

APPARATUS AND METHOD FOR IN-SITU STABILIZATION OF UNCONSOLIDATED SEDIMENT IN CORE SAMPLES

TECHNICAL FIELD

Example embodiments generally relate to coring sediments from the earth, and more specifically relate to an improved apparatus and method for coring unconsolidated sediments from the earth.

BACKGROUND

Wellbores are sometimes drilled into subterranean formations that contain hydrocarbons to allow recovery of the hydrocarbons. The formation materials encountered while drilling into a subterranean formation can vary widely depending on the location and depth of the desired reservoir. In order to properly characterize the materials in a wellbore, one or more samples may be taken and tested to determine a variety of properties of the materials. Specific samples may be taken in various forms including cuttings from the formation in the returned drilling fluids during drilling or special samples cut for testing that are commonly referred to as core samples.

Core samples may be cut using core cutters to produce the samples in a variety of diameters and lengths. The resulting core samples may then be tested in a testing apparatus to determine one or more physical properties of the sample such as the permeability, porosity, fluid flow or fluid or gas saturations in the sample. Special testing apparatuses may be used and specific methods may be carried out to determine the various properties of the samples. Core samples acquired in the subsurface of the earth are generally recovered with a core barrel that either has a disposable inner barrel or a disposable inner barrel liner. At the surface, the core barrel is separated from the coring assembly and placed on the drilling rig floor or other work area.

If the core material is unconsolidated, the core is "stabilized" to prevent mechanical damage caused by handling and shipment. Core stabilization may either be by freezing with dry ice to artificially consolidate the core, or by filling an annular space of the core barrel with a non-reactive core stabilizing compound, for example, epoxy or gypsum. FIG. 1 illustrates, in transverse cross section, an inner barrel or wall 102, enclosing a core sample 104. Because core sample 104 does not completely fill inner barrel or wall 102, a void space 106 remains in an interior of inner barrel 102, which may be filled to prevent core sample 104 from moving within inner barrel or wall 102, to prevent damage to the core by handling and shipment of the samples. In both the epoxy fill or gypsum fill techniques, the inner barrel, which may be thirty feet or more in length, is first sectioned into approximately one meter segments. Each segment is placed on a rack in a near horizontal position to drain any drilling fluid, or mud, from the inner barrel. The base of the segment is then stabilized. After the base is stabilized, the segment is placed in a near vertical position and the entire segment stabilized. Thus, the present methodologies entail substantial handling of the inner barrel and enclosed core sample, and the sample is thus susceptible to mechanical damage caused by vibration, jarring, or other movement.

Thus, there is a need in the art for apparatus and methods that reduce the risk of core damage and the stabilization of core samples in inner barrels. In particular, there is a need in the art for techniques that reduce the movement and handling of the inner barrel, and the contained core in the stabilization process, and, which advantageously permits stabilization of the full length of the inner barrel without the need for segmenting the inner barrel and contained core sample.

SUMMARY

Accordingly, example embodiments described relate to a core sampling apparatus and method for micro-coring unconsolidated sediments and in-situ sediment solidification with resin impregnation. The unconsolidated sediment can be loose sand or it can be soil in the vadose zone, with or without moisture. The corer is pushed into the sediment and retrieved largely undisturbed. The present core sampling apparatus allows in-situ resin impregnation such that the solidified core can be inspected and analyzed by different petrographic techniques depending on the type of data desired.

One example embodiment is a core sampling apparatus including a corer having an inner wall, an outer wall, and a plurality of impregnation tubes disposed between the inner and the outer wall. The impregnation tubes can be parallel to a central axis of the corer. Each of the plurality of impregnation tubes can have a plurality of holes. The inner wall may include a plurality of holes corresponding to the plurality of holes formed on the impregnation tubes, and the holes can be separated by a distance of 0.5 centimeters (cm) or more. The outer wall has a smooth outer surface to facilitate drilling into the sediment. The apparatus may further include a corer cap configured with a pump connection, the pump connection adapted to be connected to a vacuum pump for creating a vacuum to ease sampling of the core. The apparatus can also include a removable resin container, and a ring configured to connect to the removable resin container on top and the corer at the bottom, the ring including a plurality of inlets corresponding to the plurality of impregnation tubes in the corer. In one embodiment, the pump connection may be connected to a vacuum pump for facilitating resin impregnation and minimizing undesired air bubbles, or it may be used during drilling to facilitate the sampling process. The resin can include at least one of epoxy, vinylester, polyester, and combinations thereof. Alternatively, the apparatus may include a resin gun, and a ring configured to connect to the resin gun on top and the corer at the bottom, the ring including a plurality of inlets corresponding to the plurality of impregnation tubes in the corer. The apparatus can also include a core catcher attached to a lower end of the corer, the core catcher configured to collect and secure a core sample.

Another example embodiment is a method for sampling a core. The method can include extracting a core sample using a corer, and stabilizing, within the corer, unconsolidated sediment in the core sample. The apparatus can also include a core catcher attached to a lower end of the corer, the core catcher configured to collect and secure a core sample. The step of stabilizing unconsolidated sediment may include impregnating the core sample with a resin. The method can also include introducing the resin through a plurality of holes formed on an inner wall of the corer. The method can further include providing the corer with an outer wall, and disposing a plurality of impregnation tubes between the inner and the outer wall. In one embodiment, the impregnation tubes may be disposed parallel to a central axis of the corer. The method may also include providing each of the plurality of impregnation tubes with a plurality of holes. The plurality of holes on the inner wall correspond with the plurality of holes formed on the impregnation tubes, and vice versa. The method can also include providing a corer cap with a pump connection, and connecting the pump connection to a vacuum pump for creating a vacuum to ease sampling of the core. The method may also include removing the corer cap after the core sample has been collected, and connecting a removable resin container to the corer via a ring configured to connect to the removable resin container on top and the corer at the bottom, the ring including a plurality of inlets corresponding to the plurality of impregnation tubes in the corer. The method may further include providing the ring with a pump connection, and connecting the pump connection to a vacuum pump for facilitating resin impregnation and minimizing undesired air bubbles. Alternatively, the method may include removing the corer cap after the core sample has been collected, and connecting a resin gun to the corer via a ring configured to connect to the resin gun on top and the corer at the bottom, the ring including a plurality of inlets corresponding to the plurality of impregnation tubes in the corer.

BRIEF DESCRIPTION OF THE DRAWINGS

So that the manner in which the features, advantages and objects of the example embodiments, as well as others which may become apparent, are attained and can be understood in more detail, more particular description of the example embodiments briefly summarized above may be had by reference to the embodiment which is illustrated in the appended drawings, which drawings form a part of this specification. It is to be noted, however, that the drawings illustrate only example embodiments and is therefore not to be considered limiting of its scope as the invention may admit to other equally effective embodiments.

DETAILED DESCRIPTION

The methods and systems of the present disclosure will now be described more fully with reference to the accompanying drawings in which embodiments are shown. The methods and systems of the present disclosure may be in many different forms and should not be construed as limited to the illustrated embodiments set forth in this disclosure; rather, these embodiments are provided so that this disclosure will be thorough and complete, and will fully convey its scope to those skilled in the art. Like numbers refer to like elements throughout.

Example embodiments described relate to a core sampling apparatus and method for micro-coring unconsolidated sediments and in-situ sediment solidification with resin impregnation. The unconsolidated sediment can be loose sand or it can be soil in the vadose zone, with or without moisture. Sediment is pushed into the corer and retrieved largely undisturbed. The present core sampling apparatus allows in-situ resin impregnation such that the solidified core can be inspected and analyzed by different petrographic techniques depending on the type of data desired.

Figure 1:
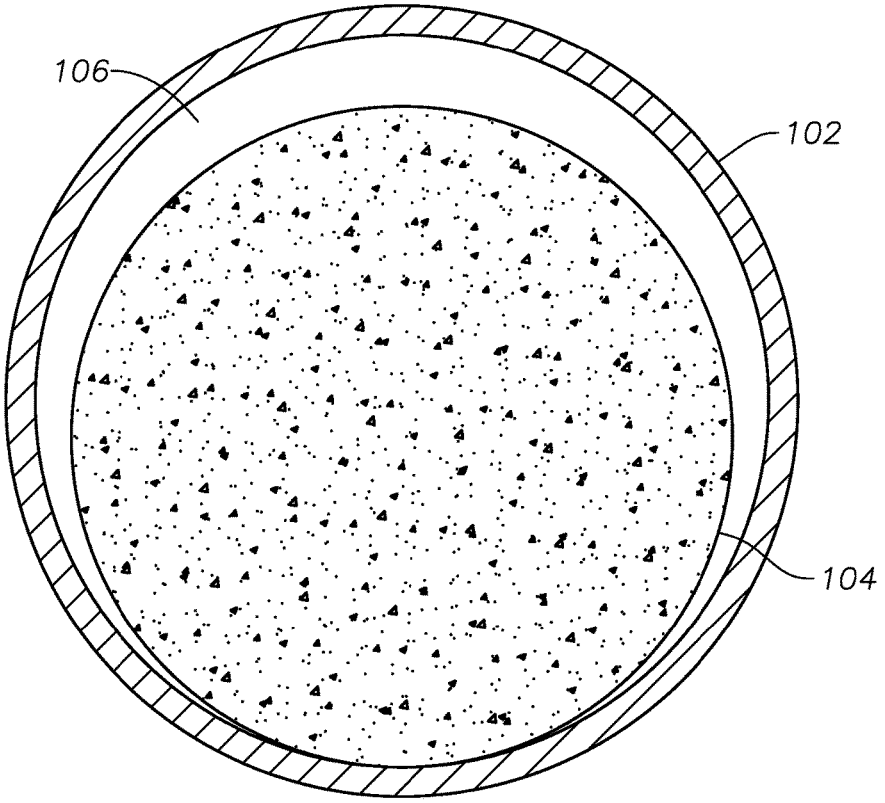
FIG. 1 (Prior Art)
FIG. 1 is a transverse cross sectional view of an inner barrel or wall of a corer, according to teachings of the prior art.
Figure 2C:
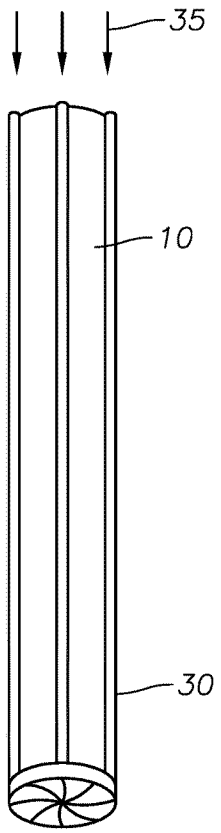
FIGS. 2A-2C illustrate a core sampling apparatus, according to one or more example embodiments of the disclosure.
Figure 2B:
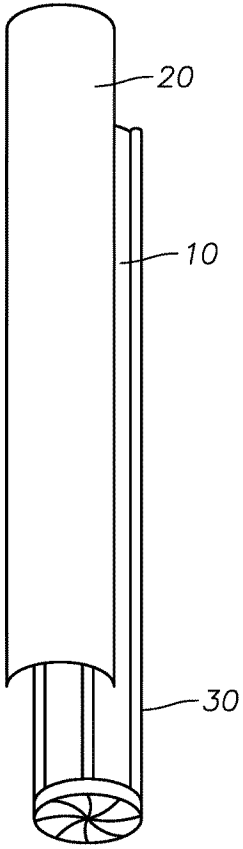
Figure 2A:
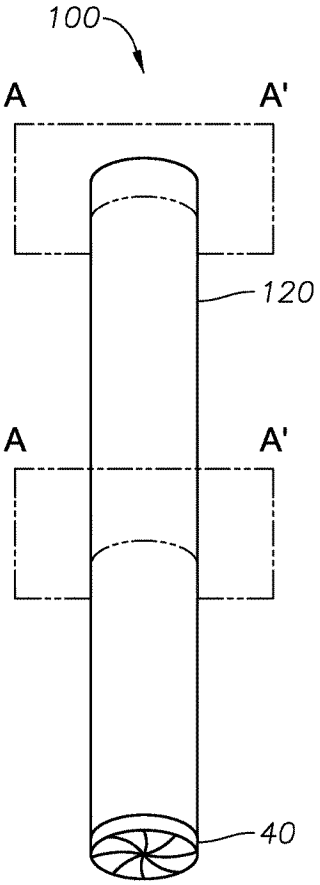

Turning now to the figures, FIGS. 2A-2C illustrate perspective views of a core sampling apparatus 100, according to one or more example embodiments of the disclosure. The core sampling apparatus 100 includes a corer 120 and a core catcher 40 attached to a lower end of the corer 120. The core catcher 40 may be configured to collect and secure a core sample, and may take any form suitable for the purpose. The corer has an inner wall 10, an outer wall 20, and a plurality of impregnation tubes 30 disposed between the inner wall 10 and the outer wall 20. The impregnation tubes 30 may be disposed parallel to a central axis of the corer 120. A resin 35, such as an epoxy or vinylester or polyester, can be supplied through these impregnation tubes 30 to be delivered into the corer 120 for in-situ stabilization of unconsolidated sediment in the core sample.

Figure 3A:
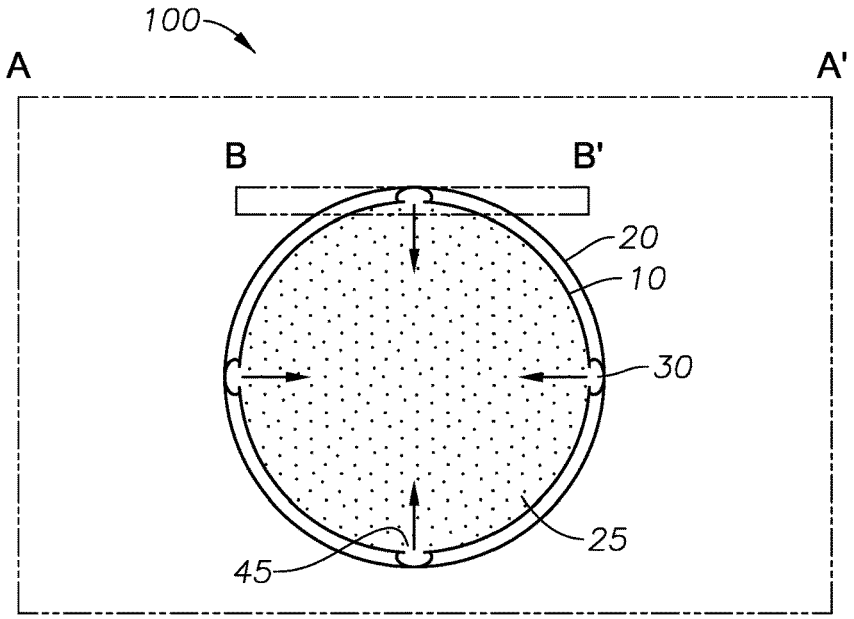
FIGS. 3A-3B are cross-sectional views of a corer in a core sampling apparatus, according to one or more example embodiments of the disclosure.
Figure 3B:
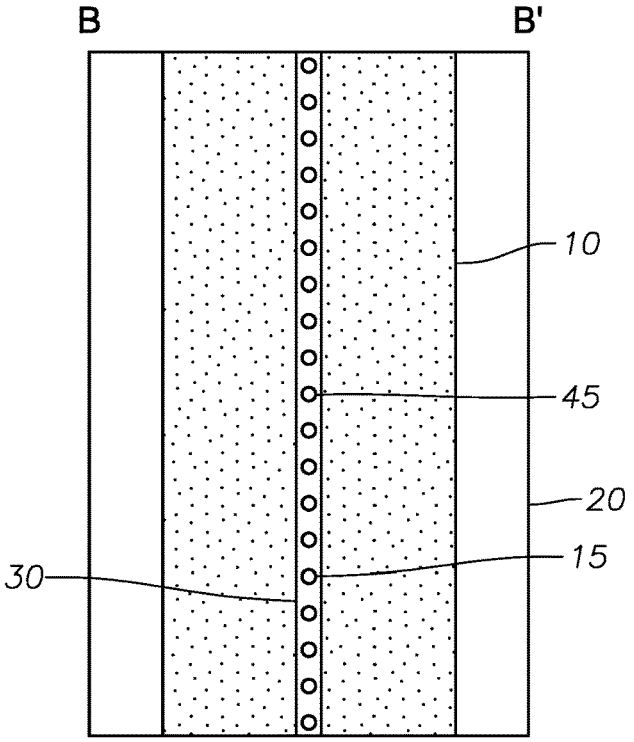

FIG. 3A is a cross-sectional view of the corer 120 along line A-A' in FIG. 2A. Although only four impregnation tubes 30 are shown in this figure, this depiction is for illustrative purposes only, and the corer 120 can have any number of impregnation tubes 30 between the inner wall 10 and outer wall 20. The small impregnation tubes 30 act as pathways for the resin to flow during the in-situ impregnation of unconsolidated sediment 25 in the core sample. The four impregnation tubes 30 are located parallel to the long axis of the corer 120 between the inner 10 and outer wall 20, quartering the outer circumference of the inner wall 10 as shown in FIG. 3A. FIG. 3B is a cross-sectional view of the corer 120 along line B-B' in FIG. 3A. As illustrated in this figure, each of the plurality of impregnation tubes 30 can have a plurality of holes 15. The inner wall 10 may include a plurality of holes 45 that correspond with the plurality of holes 15 formed on the impregnation tubes 30. The holes 45 can be separated by a distance of 0.25 cm or more, or 0.5 cm or more, or 1 cm or more. Small holes 45 connect the impregnation tubes 30 and inner wall 10 and allow the resin to enter the unconsolidated sample 25. These holes provide a sufficiently close pattern of holes to ensure thorough impregnation of the cored sediment. The outer wall 20, however, has a smooth outer surface to facilitate drilling into the sediment.

Figure 4A:
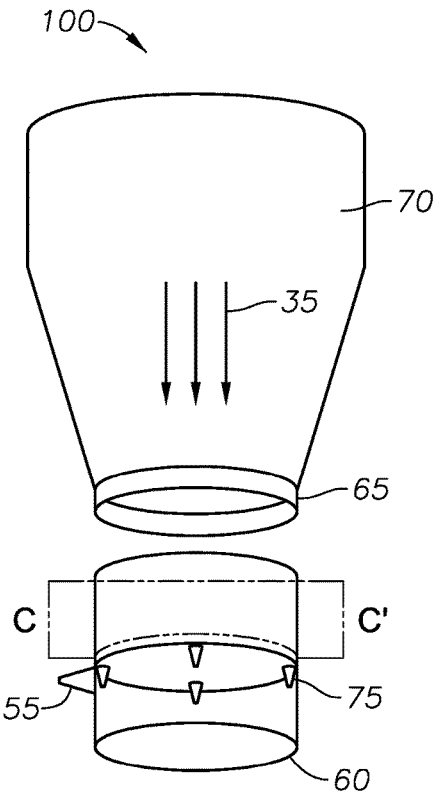
FIGS. 4A-4D are schematics of additional components of a core sampling apparatus, according to one or more example embodiments of the disclosure.
Figure 4B:
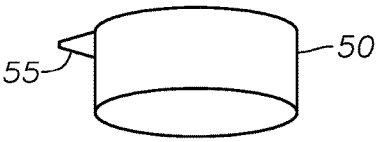
Figure 4C:
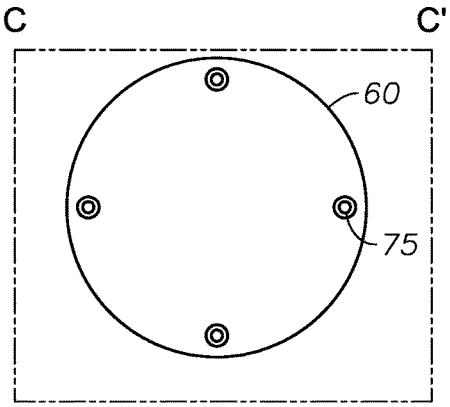

FIGS. 4A-4D are schematics of additional components of the core sampling apparatus 100, according to one or more example embodiments of the disclosure. As shown in FIG. 4B, apparatus 100 may include a corer cap 50, which may be configured with a pump connection 55. The pump connection 55 can be connected to a vacuum pump (not shown) for creating a vacuum to ease sampling of the core using the core sampling apparatus 100. As shown in FIG. 4A, apparatus 100 can also include a removable resin container 70, and a ring 60 that may be configured to connect to the removable resin container 70 on top and the corer 120 at the bottom. FIG. 4C is a cross-sectional view of the ring 60 along line C-C' in FIG. 4A. As illustrated, the ring 60 can have a plurality of inlets 75 corresponding to the plurality of impregnation tubes 30 in the corer 120. The inlets 75 can be in the form of micro-funnels that can receive the resin from the reservoir 70 and funnel it into the impregnation tubes 30 in the corer 120. The reservoir 70 may be equipped with an extended portion 65 to enable easy connection between the ring 60 and reservoir 70. The reservoir may be configured to receive pellets of the resin and provide molten resin 35 to the ring 60. The ring 60 may have another pump connection 55 which also can be connected to a vacuum pump for facilitating resin impregnation and minimizing formation of air bubbles in the resin. Although any resin known to one of skill in the art may be used for the purpose, epoxy, vinylester, polyester, and combinations thereof are just a few examples. In some embodiments, the resin may have a low viscosity, for example less than 600 centipoise (cps), to enable easy impregnation into the sediment. The resin may also have a quick drying rate such that it stabilizes the sediment in less than two hours, or even in less than one hour.

Figure 4D:
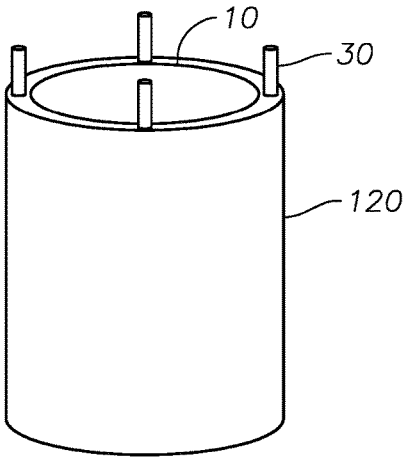
Figure 7:
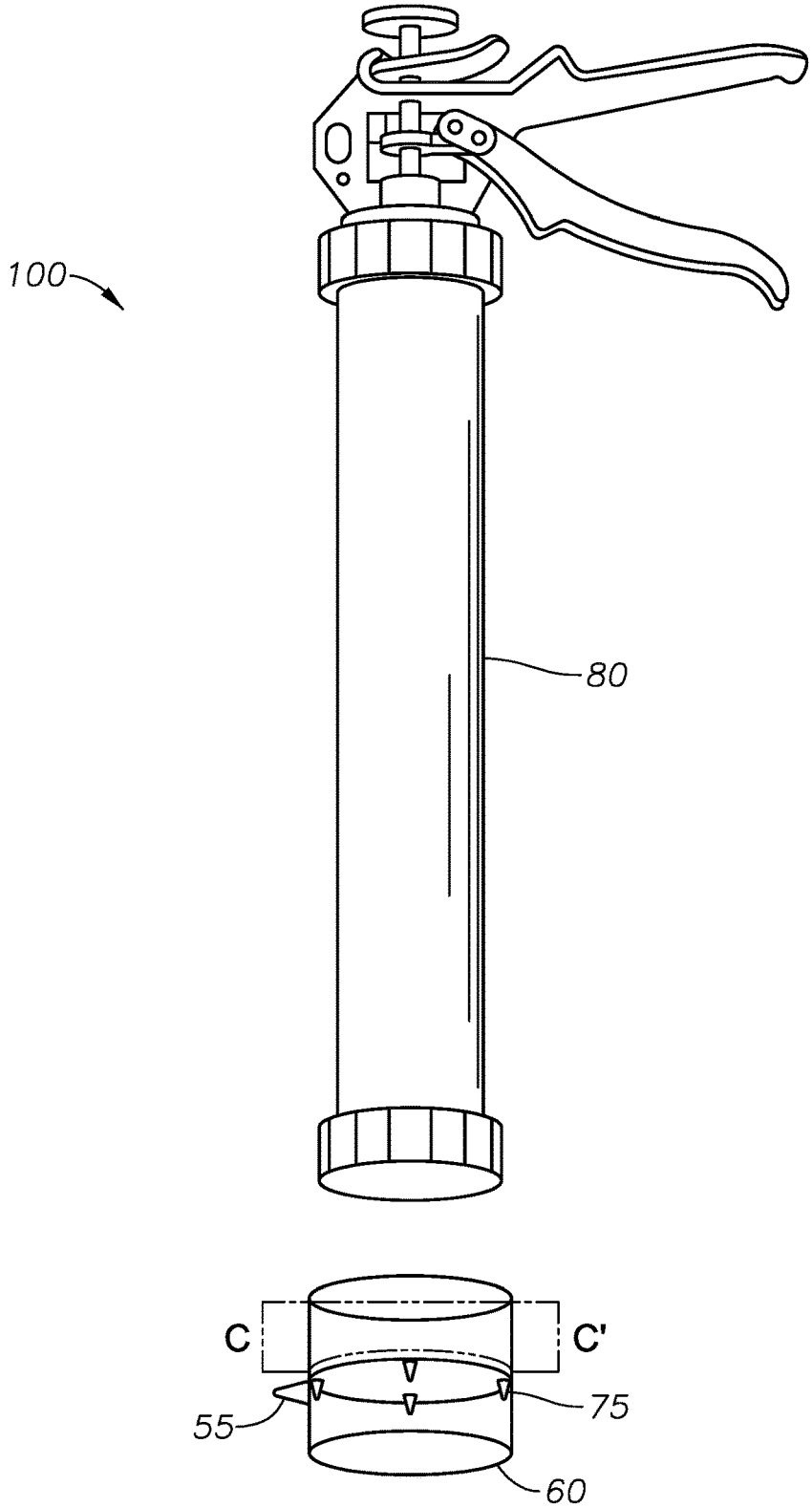
FIG. 7 is a schematic of a resin gun in a core sampling apparatus, according to one or more example embodiments of the disclosure.

FIG. 4D illustrates the top portion of the corer 120 where impregnation tubes 30 are protruding from the body of the corer 120 to ensure proper engagement with inlets 75 on the ring 60. Complete sealing may be required to prevent leakage between the micro-funnels and the top of the impregnation tubes 30. The resin reservoir 70 is a device to supply the resin for in-situ sediment solidification. It is has a funnel-shape and connects to the impregnation tubes 30 during impregnation via the micro-funnels. The resin reservoir 70 may be removed for re-filling resin during the solidification process. Alternative to the removable resin container 70, the apparatus 100 may include a resin gun 80 (shown in FIG. 7), and the ring 60 configured to connect to the resin gun on top and the corer 120 at the bottom. The resin gun 80 can be used to inject the resin into the inlet 75 such that the resin flows at a desired pressure through the impregnation tubes 30 in the corer 120. The flow rates of the resin 35 should be sufficient to fill void space 106 within a working time of the resin mixture. However, flow rates must be sufficiently slow that the flow rate of resin 35 within void space 106 will not generate stresses in core sample 104 that might disturb or disrupt the sample. In an embodiment in which the stabilizing compound is epoxy, a flow rate of 0.8 gallons per minute may be used, however, other flow rates may also be used and would be within the spirit and scope of the disclosure.

Figure 5:
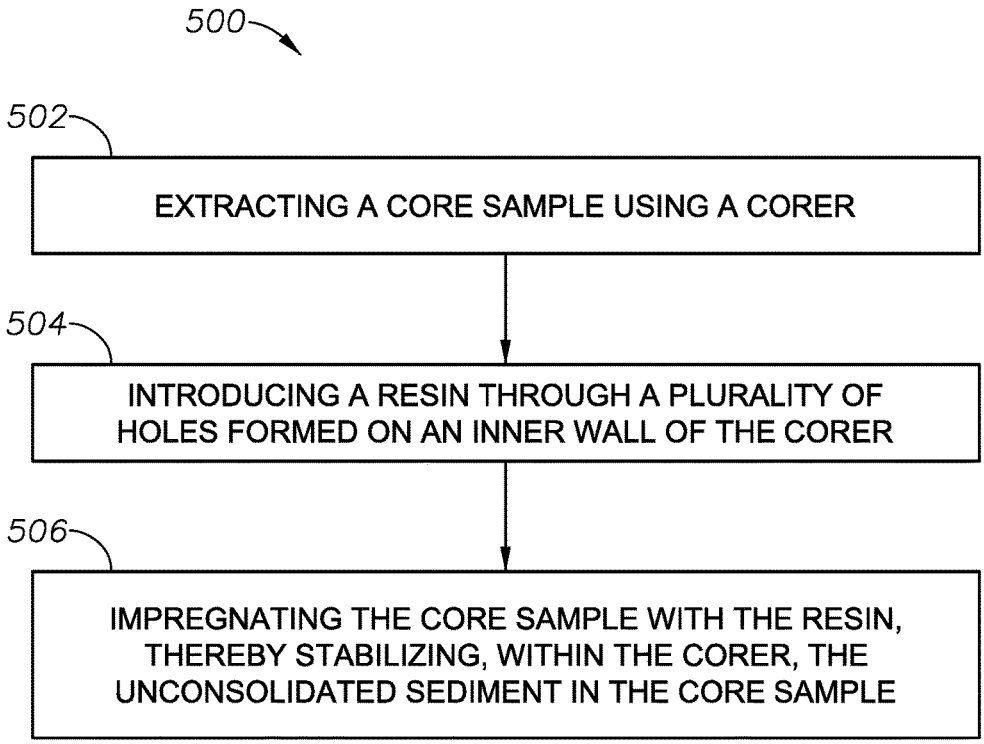
FIG. 5 illustrates example steps in a method for in-situ stabilization of unconsolidated sediment in core samples, according to one or more example embodiments of the disclosure.

FIG. 5 illustrates example steps in a method 500 for in-situ stabilization of unconsolidated sediment in core samples, according to one or more example embodiments of the disclosure. The method includes, at step 502, extracting a core sample using a corer, such as that shown in the previous figures. Step 504 includes introducing the resin through a plurality of holes formed on an inner wall of the corer. Step 506 includes impregnating the core sample with the resin, such as epoxy, or polyester, or vinylester, and thereby stabilizing unconsolidated sediment in the core sample within the corer. The method can further include providing the corer with an outer wall, and disposing a plurality of impregnation tubes between the inner and the outer wall. In one embodiment, the impregnation tubes may be disposed parallel to a central axis of the corer. The method may also include providing each of the plurality of impregnation tubes with a plurality of holes, such that the plurality of holes on the inner wall correspond with the plurality of holes formed on the impregnation tubes.

Figure 6:
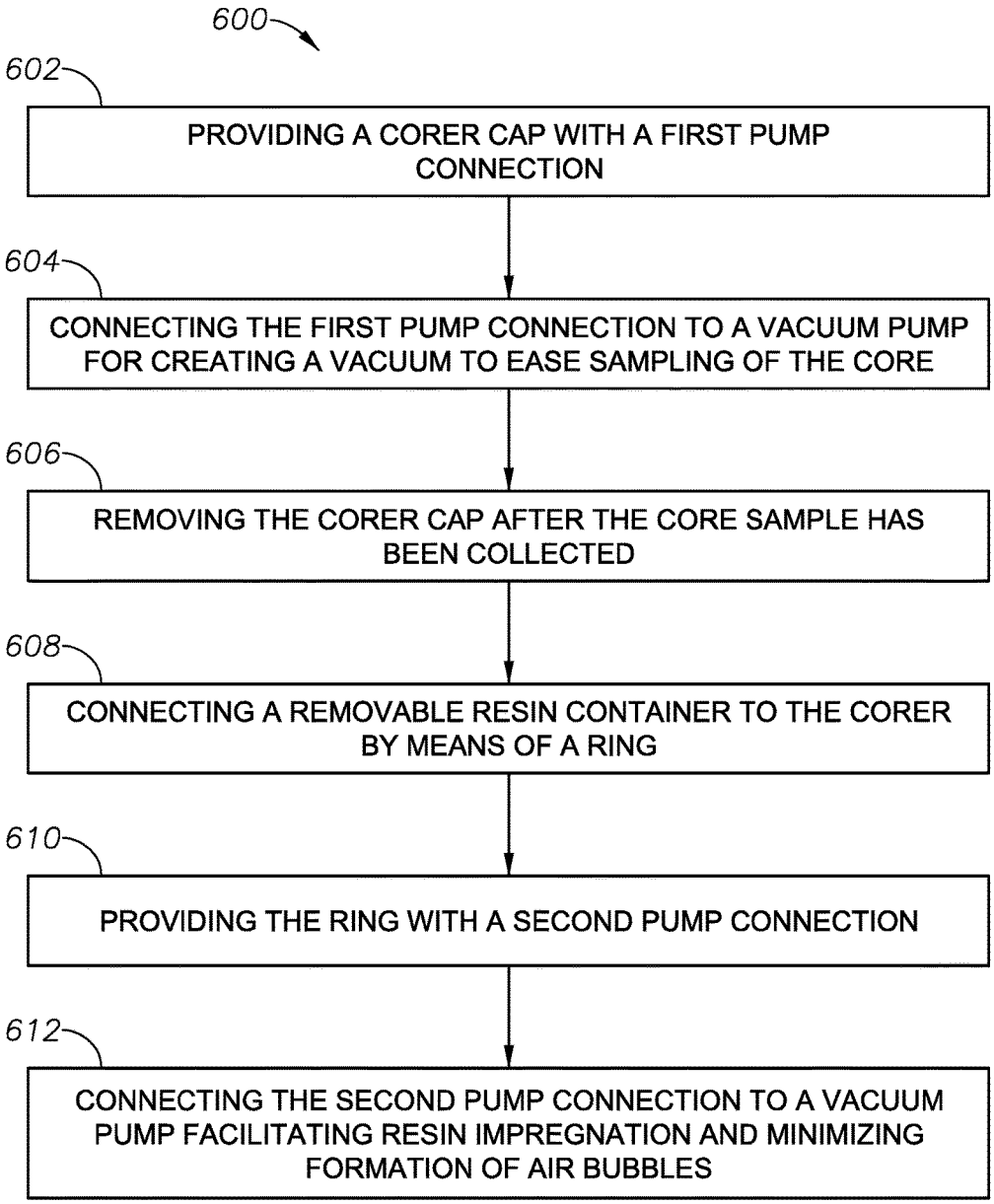
FIG. 6 illustrates example steps in a method for in-situ stabilization of unconsolidated sediment in core samples, according to one or more example embodiments of the disclosure.

FIG. 6 illustrates additional steps in a method 600 for in-situ stabilization of unconsolidated sediment in core samples, according to one or more example embodiments of the disclosure. The method can also include, at step 602, providing a corer cap with a first pump connection, and at step 604, connecting the first pump connection to a vacuum pump for creating a vacuum to ease sampling of the core. The method may also include, at step 606, removing the corer cap after the core sample has been collected in the corer, and connecting a removable resin container to the corer via a ring configured to connect to the removable resin container on top and the corer at the bottom, at step 608. The ring may include a plurality of inlets corresponding to the plurality of impregnation tubes in the corer. The method may further include, at step 610, providing the ring with a second pump connection, and at step 612, connecting the second pump connection to a vacuum pump for facilitating resin impregnation and minimizing formation of air bubbles. Alternatively, the method may include removing the corer cap after the core sample has been collected in step 606, and connecting a resin gun instead to the corer via a ring configured to connect to the resin gun on top and the corer at the bottom.

In this way, a core stabilization apparatus and method are provided. A core sample within an inner wall may be stabilized using a resin mixture without first sectioning inner wall and enclosed core sample. The core sample is stabilized along the entire length of the inner wall by simultaneously injecting the resin into the wall through a plurality of ports provided in the inner wall. Delivery of the resin mixture to the injection ports is provided through a plurality of impregnation tubes disposed between the walls of the corer. Before injecting the resin mixture, drilling mud remaining within the inner wall is expelled using a displacing gas introduced into a plurality of vent ports provided in the inner wall. The vent ports also permit the displacement of gas within the inner wall void space during injection of the core stabilizing compound, and, additionally, allow for the escape of any excess resin supplied during the injection process. Although any resin known to one of skill in the art may be used for the purpose, epoxy, vinylester, polyester, and combinations thereof are just a few examples. In some embodiments, the resin may have a low viscosity, for example less than 600 cps, to enable easy impregnation into the sediment. The resin may also have a quick drying rate such that it stabilizes the sediment in less than two hours, or even in less than one hour.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements or operations. Thus, such conditional language generally is not intended to imply that features, elements or operations are in any way required for one or more implementations or that one or more implementations necessarily include logic for deciding, with or without user input or prompting, whether these features, elements or operations are included or are to be performed in any particular implementation.

The systems and methods described, therefore, are well adapted to carry out the objects and attain the ends and advantages mentioned, as well as others that may be inherent. While example embodiments of the system and method has been given for purposes of disclosure, numerous changes exist in the details of procedures for accomplishing the desired results. These and other similar modifications may readily suggest themselves to those skilled in the art, and are intended to be encompassed within the spirit of the system and method disclosed and the scope of the appended claims.

The invention claimed is:

1. A core sampling apparatus comprising:

a corer having an inner wall, an outer wall, and a plurality of impregnation tubes disposed between the inner and the outer wall, wherein the impregnation tubes are parallel to a central axis of the corer, wherein each of the plurality of impregnation tubes have a plurality of holes.

2. The apparatus of claim 1, wherein the inner wall comprises a plurality of holes corresponding to the plurality of holes formed on the impregnation tubes.

3. The apparatus of claim 2, wherein the plurality of holes on the impregnation tubes or inner wall are separated by a distance of 0.5 cm or more.

4. The apparatus of claim 1, wherein the outer wall has a smooth outer surface to facilitate drilling into the sediment.

5. The apparatus of claim 1, further comprising:

a core catcher attached to a lower end of the corer, the core catcher configured to collect and secure a core sample.

6. A core sampling apparatus comprising:

a corer having an inner wall, an outer wall, and a plurality of impregnation tubes disposed between the inner and the outer wall, wherein the impregnation tubes are parallel to a central axis of the corer; and a corer cap configured with a pump connection, the pump connection adapted to be connected to a vacuum pump for creating a vacuum to ease sampling of the core.

7. A core sampling apparatus comprising:

a corer having an inner wall, an outer wall, and a plurality of impregnation tubes disposed between the inner and the outer wall, wherein the impregnation tubes are parallel to a central axis of the corer;

a removable resin container; and a ring configured to connect to the removable resin container on top and the corer at the bottom, the ring comprising a plurality of inlets corresponding to the plurality of impregnation tubes in the corer.

8. The apparatus of claim 7, wherein the ring comprises a pump connection, the pump connection adapted to be connected to a vacuum pump for facilitating resin impregnation and minimizing undesired air bubbles.

9. The apparatus of claim 7, wherein the resin comprises at least one of epoxy, vinylester, and polyester.

10. A core sampling apparatus comprising:

a corer having an inner wall, an outer wall, and a plurality of impregnation tubes disposed between the inner and the outer wall, wherein the impregnation tubes are parallel to a central axis of the corer;

a resin gun; and a ring configured to connect to the resin gun on top and the corer at the bottom, the ring comprising a plurality of inlets corresponding to the plurality of impregnation tubes in the corer.

* * * * *